US011497278B2

(12) United States Patent
Aoki et al.

(10) Patent No.: US 11,497,278 B2
(45) Date of Patent: Nov. 15, 2022

(54) SHOE

(71) Applicant: Shimano Inc., Osaka (JP)

(72) Inventors: Toshiaki Aoki, Osaka (JP); Kaoru Ouchi, Osaka (JP)

(73) Assignee: Shimano Inc., Osaka (JP)

( * ) Notice: Subject to any disclaimer, the term of this patent is extended or adjusted under 35 U.S.C. 154(b) by 0 days.

(21) Appl. No.: 17/318,381

(22) Filed: May 12, 2021

(65) Prior Publication Data

US 2021/0368946 A1 Dec. 2, 2021

(30) Foreign Application Priority Data

May 28, 2020 (JP) ..... JP2020-093323

(51) Int. Cl.
*A43C 11/14* (2006.01)

(52) U.S. Cl.
CPC ..... *A43C 11/1493* (2013.01)

(58) Field of Classification Search
CPC ... A43C 11/1493; A43C 11/165; A43C 1/003; A43C 1/00; A43B 3/0047; A43B 23/0245
See application file for complete search history.

(56) References Cited

U.S. PATENT DOCUMENTS 4,114,297 A * 9/1978 Famolare, Jr. ..... A43C 11/008 36/129
4,275,513 A * 6/1981 Antonious ..... A43C 11/1493 24/306
4,414,761 A * 11/1983 Mahood ..... A43C 1/00 24/712
5,230,171 A * 7/1993 Cardaropoli ..... A43C 11/22 36/51
6,543,159 B1 * 4/2003 Carpenter ..... A43C 11/1493 36/88
7,765,721 B2 * 8/2010 Hentz, III ..... A43B 1/0081 24/712.1
8,468,657 B2 * 6/2013 Soderberg ..... A43C 1/06 242/395
9,055,779 B2 * 6/2015 Oouchi ..... A43B 5/14
9,795,184 B2 * 10/2017 Ueda ..... A43B 5/14
9,814,281 B2 * 11/2017 Fisher ..... A43C 1/003
10,499,710 B2 * 12/2019 Innocente ..... A43C 11/12
2019/0021447 A1 * 1/2019 Whewell ..... A43C 11/004
2020/0390196 A1 * 12/2020 Manzato ..... A43C 11/14

FOREIGN PATENT DOCUMENTS

EP 0388989 A2 * 3/1990
JP 3210703 U 6/2017

* cited by examiner

*Primary Examiner* — Robert Sandy
*Assistant Examiner* — Louis A Mercado
(74) *Attorney, Agent, or Firm* — Global IP Counselors, LLP

(57) ABSTRACT

A shoe includes a sole, an upper and a strap. The upper is attached to the sole. The strap extends in a width direction of the shoe. The strap includes a proximal end fixed to the upper and a distal end located on an opposite side of the proximal end in the width direction of the shoe. One of the upper and the strap includes at least one first engaging portion, whereas the other of the upper and the strap includes at least one second engaging portion that is engaged with the at least one first engaging portion while extending in a direction intersecting with a longitudinal direction of the shoe where the distal end is held against the upper.

8 Claims, 12 Drawing Sheets

SHOE

CROSS-REFERENCE TO RELATED APPLICATIONS

This application claims priority to Japanese Patent Application No. 2020-093323, filed on May 28, 2020. The entire disclosure of Japanese Patent Application No. 2020-093323 is hereby incorporated herein by reference.

BACKGROUND

Technical Field

The present disclosure generally relates to a relates to a shoe that is configured to be put on a foot.

Background Information

Japanese Utility Model Registration No. 3210703 discloses a shoe including a strap for securing a foot inside a shoe. The strap extends in a width direction of the shoe. The strap is fixed at one width-directional end thereof to an upper of the shoe, while being held at the other width-directional end (free end) thereof against the upper by a hook-and-loop fastener.

SUMMARY

Regarding a conventional type of shoe, it has been concerned that the strap, when held at the free end thereof against the upper, is displaced in position with respect to the upper in a longitudinal direction of the shoe. When the strap is displaced in position with respect to the upper in the longitudinal direction of the shoe, chances are that a tightening force required to secure a foot inside the shoe cannot be obtained. Also, chances are that the strap cannot tighten an appropriate position of the shoe to secure the foot inside the shoe.

It is an object of the present disclosure to provide a shoe whereby a strap is unlikely to be displaced in position with respect to the upper where the strap is held at a free end thereof against an upper.

A shoe according to a first aspect of the present disclosure is a shoe that comprises a sole, an upper and a strap. The upper is attached to the sole. The strap extends in a width direction of the shoe. The strap includes a proximal fixed to the upper and a distal end located on an opposite side of the proximal end in the width direction of the shoe. One of the upper and the strap includes at least one first engaging portion. The other of the upper and the strap includes at least one second engaging portion that is engaged with the at least one first engaging portion while extending in a direction intersecting with a longitudinal direction of the shoe where the distal end is held against the upper.

In the shoe according to the first aspect, when the distal end of the strap is held against the upper, the at least one second engaging portion is engaged with the at least one first engaging portion. Accordingly, the strap, when held at the distal end thereof against the upper, is unlikely to be displaced in position with respect to the upper. Here, the distal end is a free end of the strap.

A shoe according to a second aspect relates to the shoe according to the first aspect, wherein the at least one first engaging portion includes at least one first protrusion. The at least one second engaging portion includes a plurality of second protrusions arranged in the longitudinal direction of the shoe. The at least one first protrusion is configured to be engaged between adjacent two of the plurality of second protrusions where the distal end is held against the upper. In the shoe according to the second aspect, the strap, when held at the distal end thereof against the upper, can be inhibited from being displaced in position with respect to the upper with a simple configuration. Also, when the at least one first engaging portion and the at least one second engaging portion are engaged, the at least one first engaging portion can be guided by adjacent two of the plurality of second protrusions.

A shoe according to a third aspect relates to the shoe according to the first aspect, wherein the at least one first engaging portion includes at least one first protrusion. The at least one second engaging portion includes at least one groove. The at least one first protrusion is configured to be engaged with the at least one groove where the distal end is held against the upper. In the shoe according to the third aspect, the strap, when held at the distal end thereof against the upper, can be inhibited from being displaced in position with respect to the upper with a simple configuration. Also, when the at least one first engaging portion and the at least one second engaging portion are engaged, the at least one first protrusion can be guided by the at least one groove.

A shoe according to a fourth aspect relates to the shoe according to any one of the first to third aspects, wherein the at least one first engaging portion extends in the direction intersecting with the longitudinal direction of the shoe when the distal end is held against the upper. In the shoe according to the fourth aspect, the strap, when held at the distal end thereof against the upper, becomes further unlikely to be displaced in position with respect to the upper. Also, the strap becomes likely to be guided in a tightening direction.

A shoe according to a fifth aspect relates to the shoe according to any one of the first to fourth aspects and further includes a tightening structure configured to apply a tension to the strap. In the shoe according to the fifth aspect, the tension can be easily applied to the strap by the tightening structure. Also, the strap, when tightened, can be further reduced in positional displacement with respect to the upper by using the tightening structure together with the at least one first engaging portion and the at least one second engaging portion.

A shoe according to a sixth aspect relates to the shoe according to the fifth aspect, wherein the at least one second engaging portion is provided on the upper. The tightening structure applies the tension to the strap such that the tension is directed along the at least one second engaging portion. In the shoe according to the sixth aspect, the strap, when tightened by the tightening structure, becomes unlikely to be displaced in position with respect to the upper.

A shoe according to a seventh aspect relates to the shoe according to the fifth or sixth aspect, wherein the tightening structure includes a lace member and a reel-up member. The lace member is attached to one of the upper and the strap. The reel-up member is attached to the other of the upper and the strap. The reel-up member is configured to reel up the lace member. In the shoe according to the seventh aspect, tightening the strap and adjusting a force for tightening the strap are made easy.

A shoe according to an eighth aspect relates to the shoe according to any one of the first to seventh aspects, wherein one of the at least one first engaging portion and the at least one second engaging portion is made of a mesh material. In the shoe according to the eighth aspect, forming the one of the at least one first engaging portion or the at least one second engaging portion is made easy. Also, the one of the at least one first engaging portion or the at least one second engaging portion can be made breathable. Moreover, the one of the at least one first engaging portion or the at least one second engaging portion can be made lighter in weight.

A shoe according to a ninth aspect relates to the shoe according to the eighth aspect, wherein the one of the at least one first engaging portion and the at least one second engaging portion is provided on the strap. In the shoe according to the ninth aspect, it is made easier to keep softness in material of the strap than when the one of the at least one first engaging portion or the at least one second engaging portion is directly formed on the strap. Also, it is easy to make the strap breathable.

According to the present disclosure, it is possible to provide a shoe whereby a strap, when held at a free end thereof against an upper, is unlikely to be displaced in position with respect to the upper. Also, other objects, features, aspects and advantages of the disclosed shoe will become apparent from the following detailed description, which, taken in conjunction with the annexed drawings, discloses preferred embodiments of the disclosed shoe.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the footwear field from this disclosure that the following descriptions of the embodiments are provided for illustration only and not for the purpose of limiting the invention as defined by the appended claims and their equivalents.

Figure 1:
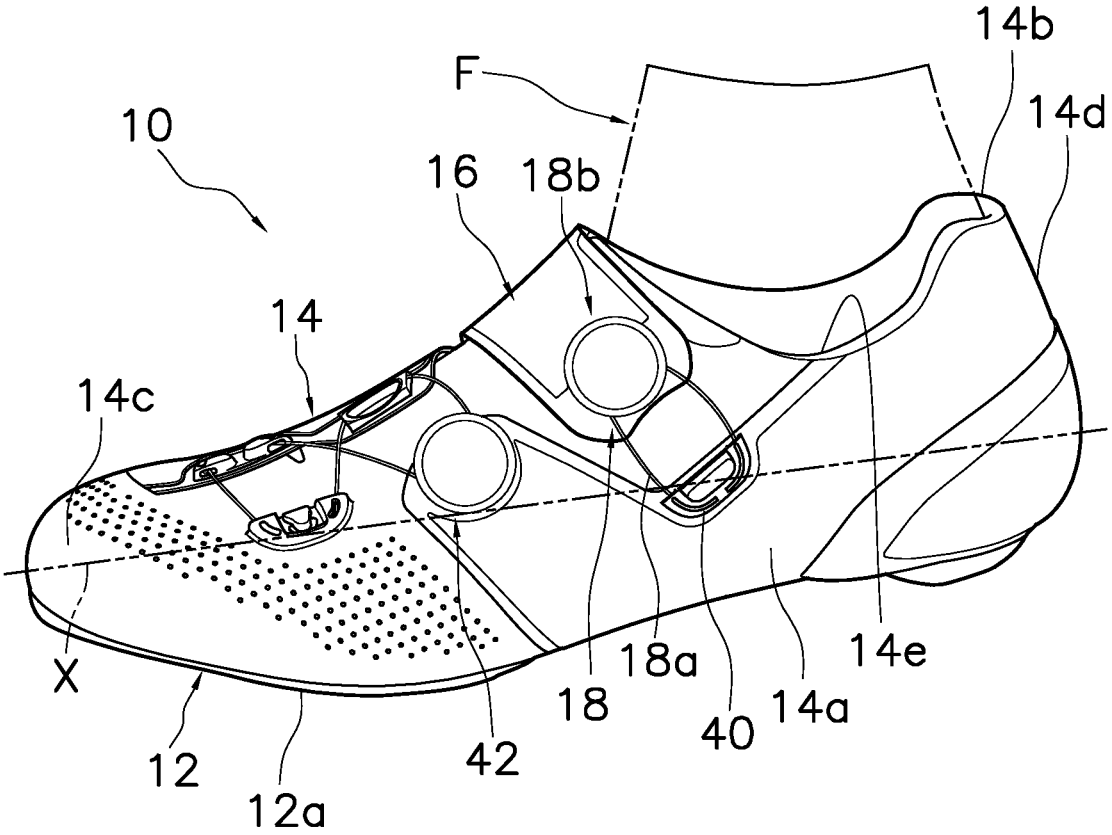
FIG. 1 is a side perspective view of a shoe according to one embodiment.

FIG. 1 is a side perspective view of a shoe 10 according to the present disclosure. As shown in FIG. 1, the shoe 10 is configured to be put on a foot F. The shoe 10 according to the present disclosure is applicable as well to footwear such as shoes for sport use, sneakers, or slippers with straps. It should be noted that the present specification explains a shoe to be put on the left foot but omits explanation of a shoe to be put on the right foot. The shoe 10 basically includes a sole 12, an upper 14, and a strap 16. The shoe 10 preferably further includes a tightening structure 18 (i.e., a strap tightener).

The sole 12 supports the foot sole. The sole 12 includes an outsole 12*a*. Also, the sole 12 includes an insole (not shown in the drawings). Regarding the sole 12, the insole is provided on the opposite side of the outsole 12*a*. The outsole 12*a* faces outside the shoe 10. For example, the outsole 12*a* touches the ground. The insole faces inside the shoe 10. The insole touches the foot sole.

The upper 14 covers the top of the foot F. The upper 14 is attached to the sole 12. The upper 14 is attached to the insole side of the sole 12. The upper 14 includes a left upper portion 14*a* located on the left side of the shoe 10 and a right upper portion 14*b* located on the right side of the shoe 10. It should be noted that the terms "right" and "left" of the shoe 10 herein refer to those in a view of the shoe 10 as seen from behind (heel side) looking toward the toe of the shoe 10. Also, a top side of the upper 14 of the shoe 10 corresponds to the upper side of the shoe 10, whereas a bottom side of the sole 12 of the shoe 10 corresponds to the lower side of the shoe 10. The upper 14 further includes a front upper portion 14*c* and a rear upper portion 14*d*. The front upper portion 14*c* is located on the front side of the shoe 10. The rear upper portion 14*d* is located on the rear side of the shoe 10. The front side of the shoe 10 corresponds to the toe side of the shoe 10. The rear side of the shoe 10 corresponds to the heel side of the shoe 10. For example, the front upper portion 14*c* covers a toe region and a top region of the foot. For example, the rear upper portion 14*d* covers a heel region of the foot. The front upper portion 14*c* and the rear upper portion 14*d* connect the left upper portion 14*a* and the right upper portion 14*b*. The upper 14 further includes an opening 14*e*. The opening 14*e* is a portion that the foot F is inserted when the shoe 10 is put on. For example, the opening 14*e* is defined by a topline (a top edge of the upper 14).

The opening 14*e* is provided on the rear upper portion 14*d* side. The opening 14*e* is opened upward. For example, the opening 14*e* is surrounded by the left upper portion 14*a*, the right upper portion 14*b*, the front upper portion 14*c*, and the rear upper portion 14*d*. The opening 14*e* is provided on the opposite side of the sole 12 with respect to the upper portions 14*a*, 14*b*, 14*c*, and 14*d*. For example, when the shoe 10 is of a type without the rear upper portion 14*d*, the opening 14*e* is surrounded by the left upper portion 14*a*, the right upper portion 14*b*, the front upper portion 14*c*, and the sole 12. The shoe 10 of the type is, for example, a sandal. On the other hand, for example, when the shoe 10 is of a type covering the foot up to the ankle, the left upper portion 14*a*, the right upper portion 14*b*, the front upper portion 14*c*, and the rear upper portion 14*d* extend to the ankle. When the shoe 10 is of a type covering the foot up to a region above the ankle, the left upper portion 14*a*, the right upper portion 14*b*, the front upper portion 14*c*, and the rear upper portion

14*d* extend to the region above the ankle. The shoe 10 of the type is, for example, a boot. It should be noted that the strap is additionally provided on a portion of the shoe 10 that covers the region above the ankle. Besides, several engaging portions 20 and 30 (to be described) in the present embodiment are additionally provided on the portion of the shoe 10 that covers the region above the ankle.

Figure 2:
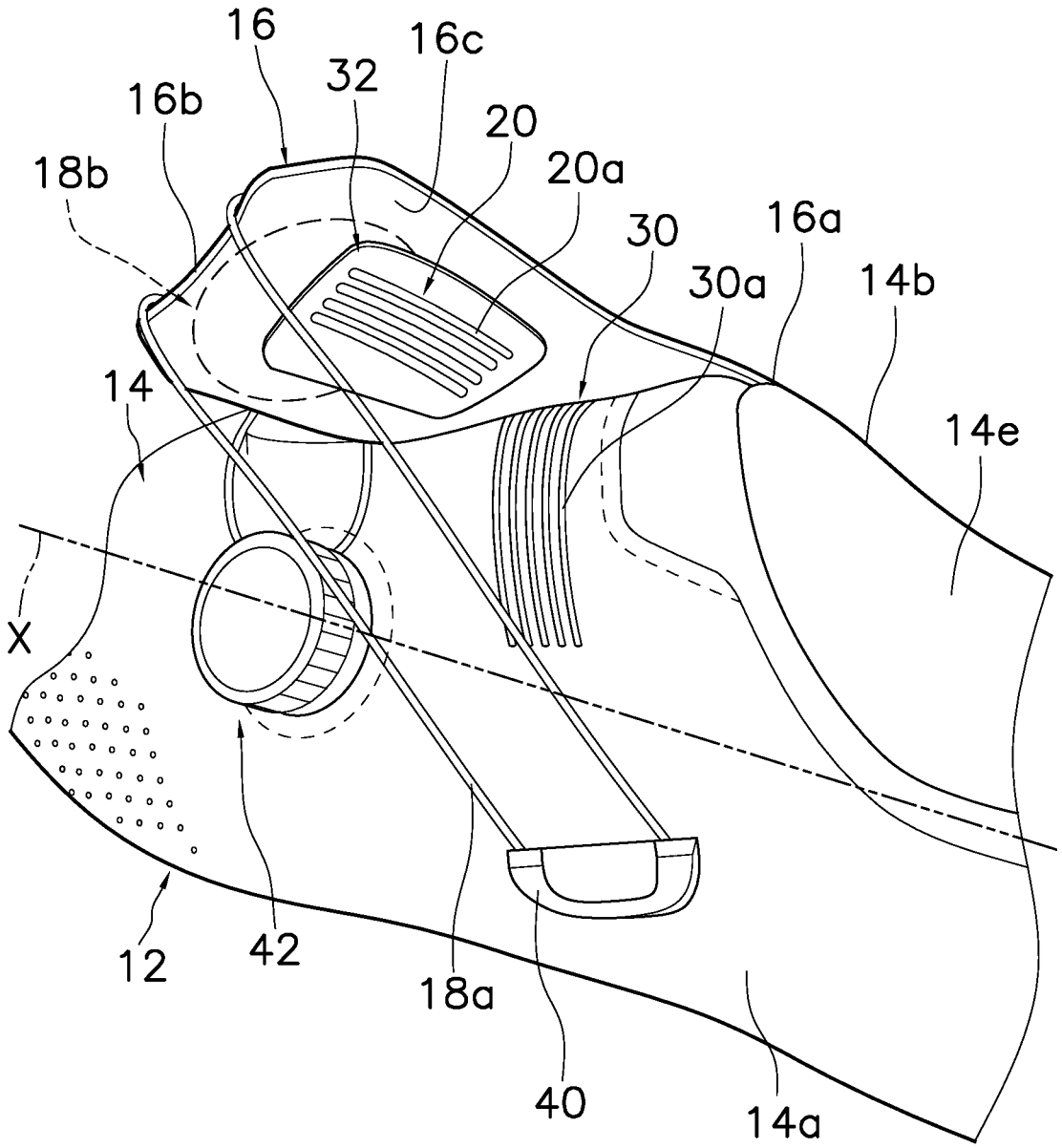
FIG. 2 is a perspective view of a portion of the shoe illustrated in FIG. 1 and showing a condition that engagement between an upper and a strap of the shoe has been released.
Figure 3:
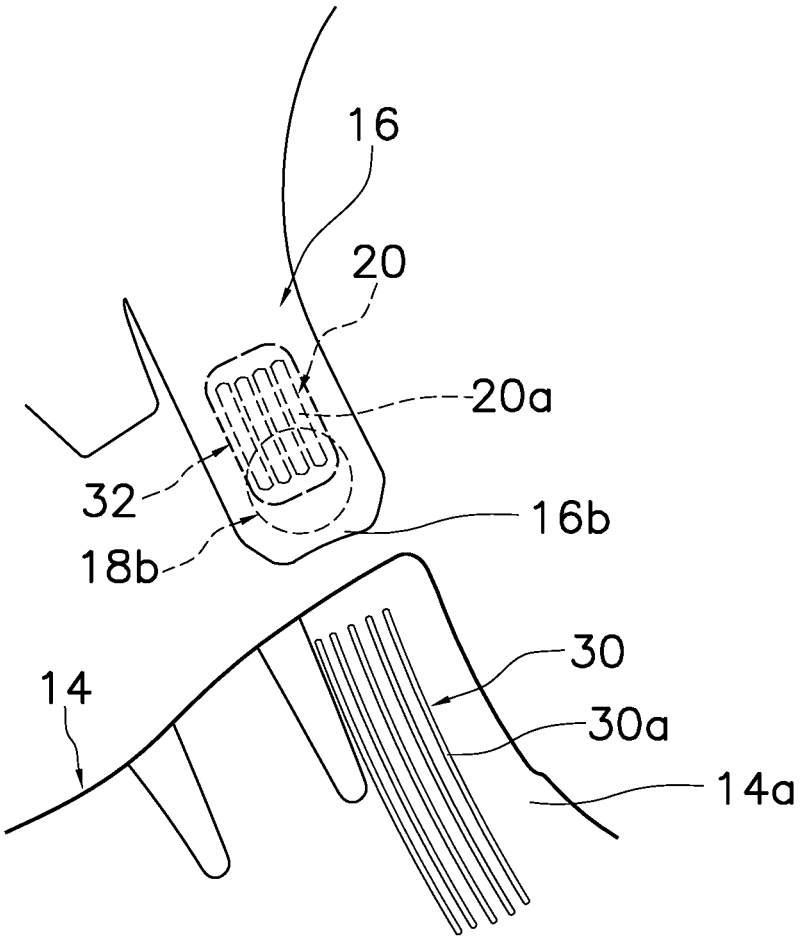
FIG. 3 is a schematic diagram of a portion of the shoe illustrated in FIG. 1 for explaining the engagement between the upper and the strap.
Figure 4:
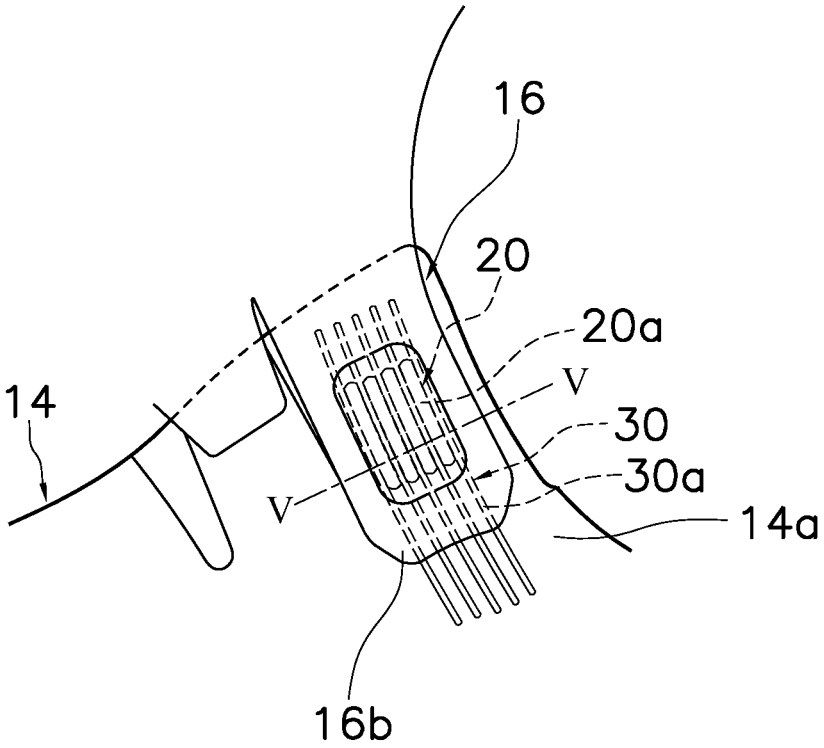
FIG. 4 is a schematic diagram of a portion of the shoe illustrated in FIG. 1 for explaining the engagement between the upper and the strap.
Figure 5:
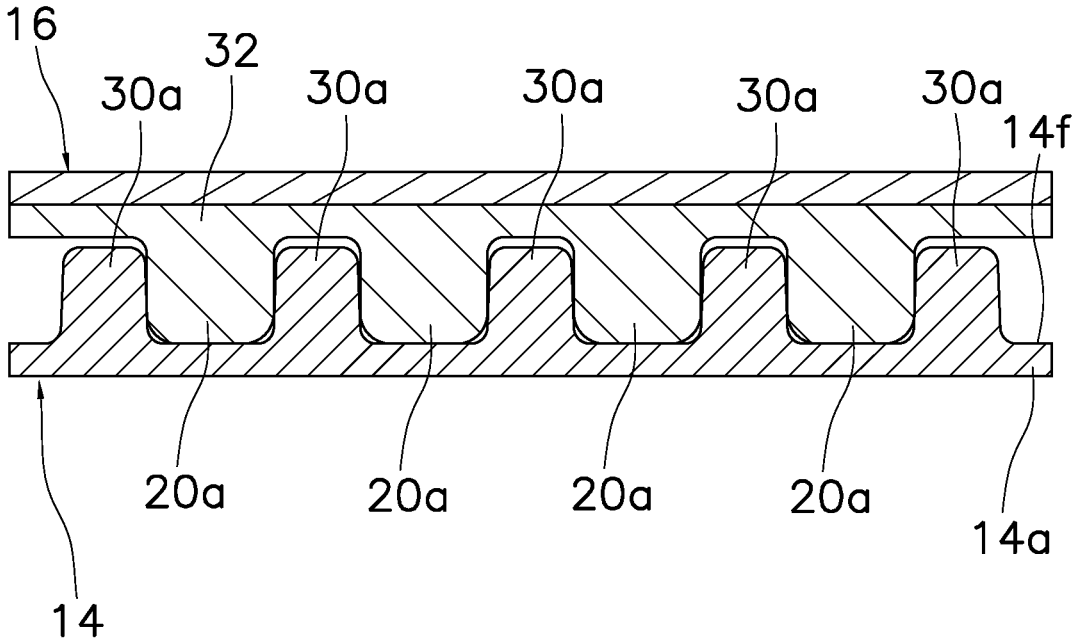
FIG. 5 is a cross-sectional view of a portion of the shoe illustrated in FIG. 4 taken along section line V-V of FIG. 4.

FIG. 2 is a perspective view of a portion of the shoe 10 showing a condition that engagement between the upper 14 and the strap 16 has been released. FIGS. 3 and 4 are schematic diagrams of portion of the shoe 10 for explaining the engagement between the upper 14 and the strap 16. FIG. 5 is a cross-sectional view of a portion of the shoe 10 taken along section line V-V of FIG. 4.

The strap 16 extends in a width direction of the shoe 10. The strap 16 includes a proximal end 16*a* and a distal end 16*b*. The proximal end 16*a* is fixed to the upper 14. In the present embodiment, the proximal end 16*a* is fixed to the right upper portion 14*b*. The distal end 16*b* is located on the opposite side of the proximal end 16*a* in the width direction of the shoe 10. The distal end 16*b* is a free end of the strap 16. The distal end 16*b* is configured to be held against the upper 14. In the present embodiment, the distal end 16*b* is configured to be held against the left upper portion 14*a*. In the present embodiment, as described below, the upper 14 is provided, as a part thereof, with a second engaging portion 30. However, the second engaging portion 30 is attachable to the upper 14 as a discrete component.

One of the upper 14 and the strap 16 includes at least one first engaging portion 20. The other of the upper 14 and the strap 16 includes at least one second engaging portion 30. When the distal end 16*b* is held against the upper 14, the at least one second engaging portion 30 is engaged with the at least one first engaging portion 20. The at least one second engaging portion 30 extends in a direction intersecting with a longitudinal direction X of the shoe 10. The longitudinal direction X of the shoe 10 is a direction indicating the entire toe-to-heel length of the shoe 10. In the present embodiment, the strap 16 includes the at least one first engaging portion 20, whereas the upper 14 includes the at least one second engaging portion 30.

One of the at least one first engaging portion 20 and the at least one second engaging portion 30 is preferably made of a mesh material. Also, the one of the at least one first engaging portion 20 and the at least one second engaging portion 30 is provided on the strap 16. The mesh is the whole or a part of a material made of strings or wires interlaced like a net. The net is formed by interlacing the yarns or wires with one another at regular intervals. In the present embodiment, the at least one first engaging portion 20 is made of the mesh material. It should be noted that the at least one first engaging portion 20 can be integrally provided on the strap 16.

The at least one first engaging portion 20 includes at least one first protrusion 20*a*. In the present embodiment, the at least one first protrusion 20*a* is disposed on a back surface 16*c* side of the distal end 16*b* of the strap 16. The back surface 16*c* is opposed to the upper 14 where the distal end 16*b* is held against the upper 14. Also, in the present embodiment, the at least one first protrusion 20*a* comprises part of a mesh member 32. The at least one first protrusion 20*a* protrudes in a direction from the strap 16 to the upper 14 in a condition of engagement between the upper 14 and the strap 16. The condition of engagement between the upper 14 and the strap 16 refers to a condition of engagement between the at least one first protrusion 20*a* and the at least one second engaging portion 30. In other words, the condition of engagement between the upper 14 and the strap 16 refers to a condition that the distal end 16*b* is held against the upper 14. The at least one first protrusion 20*a* extends in the direction intersecting with the longitudinal direction X of the shoe 10 where the distal end 16*b* is held against the upper 14. It should be noted that the at least one first protrusion 20*a* may not necessarily extend in the direction intersecting with the longitudinal direction X of the shoe 10 where the distal end 16*b* is held against the upper 14. It should be noted that in the present embodiment, the at least one first engaging portion 20 includes a plurality of first protrusions 20*a*. When the distal end 16*b* is held against the upper 14, the first protrusions 20*a* extend along a plurality of second protrusions 30*a* (to be described), while being arranged in the longitudinal direction X of the shoe 10.

The at least one second engaging portion 30 includes the plurality of second protrusions 30*a* arranged in the longitudinal direction X of the shoe 10. The plurality of second protrusions 30*a* are provided on, for example, the surface of the left upper portion 14*a* or that of the right upper portion 14*b*. In the present embodiment, the plurality of second protrusions 30*a* are provided on the surface of the left upper portion 14*a*. For example, the plurality of second protrusions 30*a* are formed by modifying at least the surface of the upper 14. The plurality of second protrusions 30*a* are formed by, for example, embossing. The plurality of second protrusions 30*a* protrude in a direction from the upper 14 to the strap 16 in the condition of engagement between the upper 14 and the strap 16. The plurality of second protrusions 30*a* extend in the direction intersecting with the longitudinal direction X of the shoe 10. The plurality of second protrusions 30*a* extend in a circular-arc shape in approximately the width direction of the shoe 10. It should be noted that the plurality of second protrusions 30*a* may extend in a straight shape.

As shown in FIG. 5, each of the at least one first protrusion 20*a* is engaged between adjacent two of the second protrusions 30*a* where the distal end 16*b* of the strap 16 is held against the upper 14. In FIG. 5, a surface 14*f* is the surface of the left upper portion 14*a*. The second protrusions 30*a* protrude from the surface 14*f*. It should be noted that FIGS. 2 to 4 show a configuration that the at least one first engaging portion 20 includes the plurality of first protrusions 20*a*. However, a reference sign 20*a* is assigned to only a part of the plurality of first protrusions 20*a* without being assigned to the rest thereof. Likewise, in FIGS. 2 to 4, a reference sign 30*a* is assigned to only a part of the plurality of second protrusions 30*a* without being assigned to the rest thereof. Also, FIGS. 2 to 5 show the plurality of first protrusions 20*a* and the plurality of second protrusions 30*a*. However, engagement between the first protrusions 20*a* and the second protrusions 30*a* is realized by one of the first protrusions 20*a* and two of the second protrusions 30*a*. In this case, two of the second protrusions 30*a* form therebetween a recess that one of the first protrusions 20*a* is engaged. Likewise, engagement between the first protrusions 20*a* and the second protrusions 30*a* is realized by two of the first protrusions 20*a* and one of the second protrusions 30*a*. In this case, two of the first protrusions 20*a* form therebetween a recess that one of the second protrusions 30*a* is engaged.

The tightening structure 18 applies a tension to the strap 16. The tightening structure 18 applies the tension to the strap 16 such that the tension is directed along the at least one second engaging portion 30. The at least one second engaging portion 30 is herein provided on the upper 14. The tightening structure 18, which is a heretofore known structure, includes a lace member 18*a* and a reel-up member 18*b*.

The reel-up member 18*b* is configured to reel up the lace member 18*a*. The lace member 18*a* is attached to one of the upper 14 and the strap 16. The reel-up member 18*b* is attached to the other of the upper 14 and the strap 16. In the present embodiment, the lace member 18*a* is attached to the upper 14, whereas the reel-up member 18*b* is attached to the strap 16.

In the present embodiment, the lace member 18*a* is attached to a position closer to the sole 12 than the plurality of second protrusions 30*a* on the left upper portion 14*a*. The left upper portion 14*a* is provided with a hook portion 40 for hooking the lace member 18*a*.

As an example, the reel-up member 18*b* includes a reel-up portion, a one-way clutch, and a deactivation mechanism that are not shown in the drawings. The one-way clutch prevents the reel-up portion from turning in an unreeling direction. The deactivation mechanism deactivates the one-way clutch. The reel-up member 18*b* is a member that the lace member 18*a* is attached at both ends thereof. When the reel-up member 18*b* is operated to turn, the lace member 18*a* is wound up. Accordingly, the tension acting on the strap 16 is adjusted. It should be noted that in the present embodiment, a tightening structure 42 is provided in a position forward of the tightening structure 18. The tightening structure 42 is used for tightening the left upper portion 14*a* and the right upper portion 14*b* in directions approaching each other. The tightening structure 42 has a similar structure to the tightening structure 18. It should be noted that the tightening structure 42 can be omitted.

In the shoe 10 configured as described above, when the distal end 16*b* of the strap 16 is held against the upper 14, the at least one second engaging portion 30 is engaged with the at least one first engaging portion 20. Accordingly, when the distal end 16*b* of the strap 16 is held against the upper 14, the strap 16 is unlikely to be displaced in position with respect to the upper 14.

Also, the tightening structure 18 applies the tension to the strap 16 such that the tension is directed along the at least one second engaging portion 30. Accordingly, when the distal end 16*b* of the strap 16 is held against the upper 14, the strap 16 is further unlikely to be displaced in position with respect to the upper 14.

Moreover, when the distal end 16*b* of the strap 16 is held against the upper 14, the at least one first protrusion 20*a* is engaged between adjacent two of the second protrusions 30*a*. When the tension acting on the strap 16 is adjusted by the tightening structure 18, the at least one first protrusion 20*a* is guided by adjacent two of the second protrusions 30*a* in the extending directions of the plurality of second protrusions 30*a*. Accordingly, when the tension acting on the strap 16 is adjusted by the tightening structure 18, the strap 16 is unlikely to be displaced in position with respect to the upper 14.

In the present embodiment, the at least one first protrusion 20*a* and the at least one second protrusion 30*a* extend continuously. However, at least one of the at least one first protrusion 20*a* and the at least one second protrusion 30*a* is not required to extend continuously. For example, the at least one of the at least one first protrusion 20*a* and the at least one second protrusion 30*a* can be composed of arranged circular protrusions. The protrusion extending continuously is guided by the protrusion disposed intermittently. Conversely, the protrusion disposed intermittently is guided by the protrusion extending continuously.

Other Embodiments

One embodiment of the present disclosure has been explained above. However, the present invention is not limited to the embodiment described above, and a variety of changes can be made without departing from the gist of the present invention. Especially, a plurality of embodiments and modifications described in the present specification can be arbitrarily combined on an as-needed basis.

Figure 6:
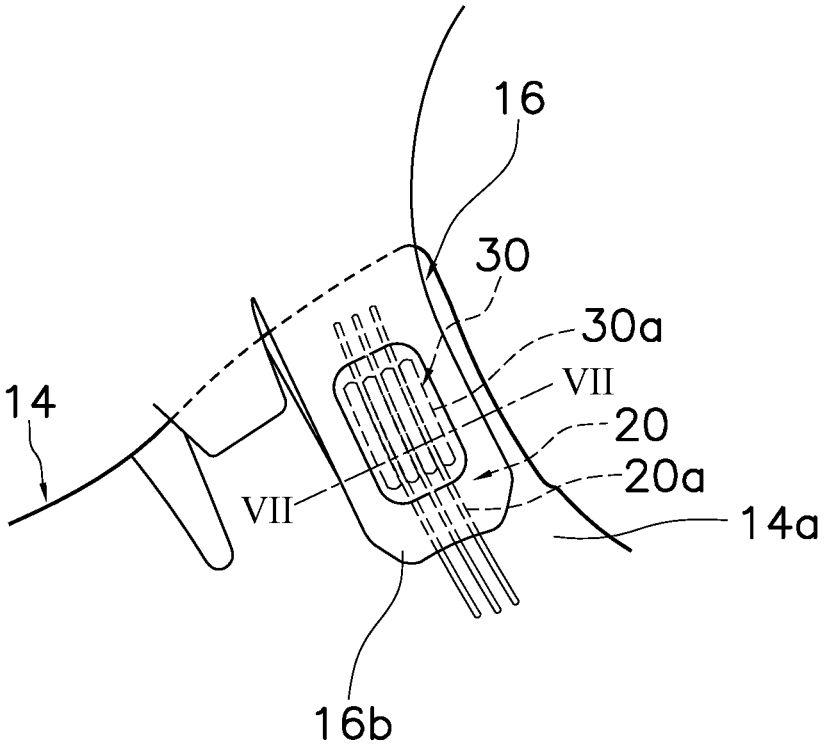
FIG. 6 is a schematic diagram of a portion of a shoe for explaining engagement between an upper and a strap according to another embodiment.

The embodiment described above has explained that the strap 16 includes the at least one first engaging portion 20, whereas the upper 14 includes the at least one second engaging portion 30. However, as shown in FIG. 6, the at least one first engaging portion 20 and the at least one second engaging portion 30 can be reversed in arrangement. In other words, the strap 16 may include the at least one second engaging portion 30, whereas the upper 14 can include the at least one first engaging portion 20.

Figure 7:
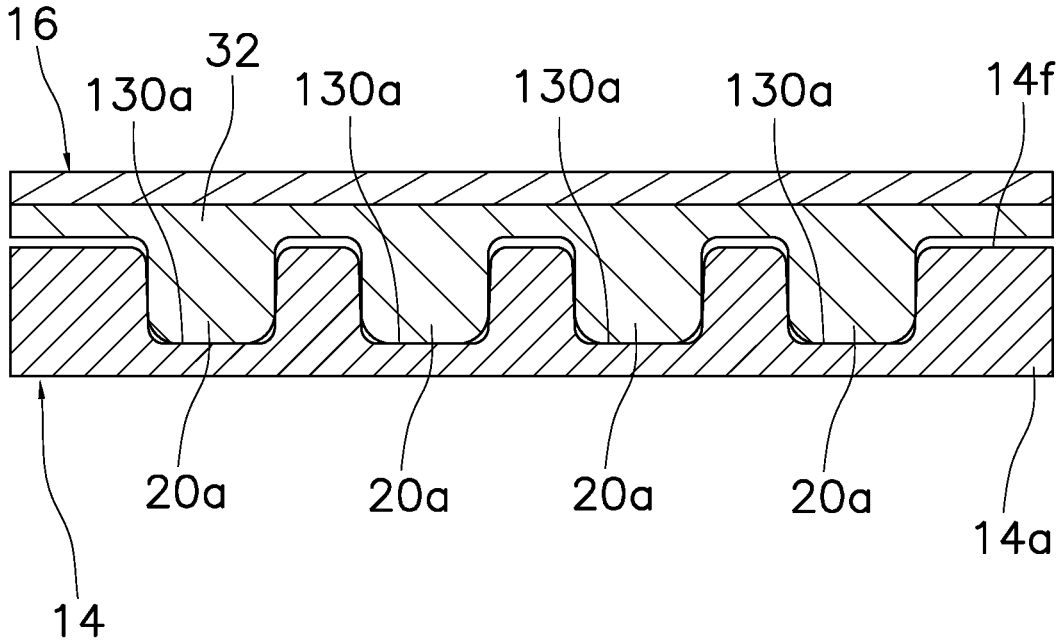
FIG. 7 is a cross-sectional view, similar to FIG. 4, of the shoe illustrated in FIG. 6 taken along section line V-V of FIG. 6 according to another embodiment.

The embodiment described above has explained that the at least one second engaging portion 30 includes the plurality of second protrusions 30*a* arranged in the longitudinal direction X of the shoe 10. However, as shown in FIG. 7, the at least one second engaging portion 30 can include at least one groove 130*a*. In FIG. 7, the surface 14*f* is the surface of the left upper portion 14*a*. The at least one groove 130*a* is recessed from the surface 14*f*. In this case, when the distal end 16*b* of the strap 16 is held against the upper 14, the at least one first protrusion 20*a* is engaged with the at least one groove 130*a*. Also, the at least one first protrusion 20*a* is not required to extend continuously. For example, the at least one first protrusion 20*a* can be composed of arranged circular protrusions. The at least one first protrusion 20*a* disposed intermittently is guided by the at least one groove 130*a* extending continuously.

Figure 8:
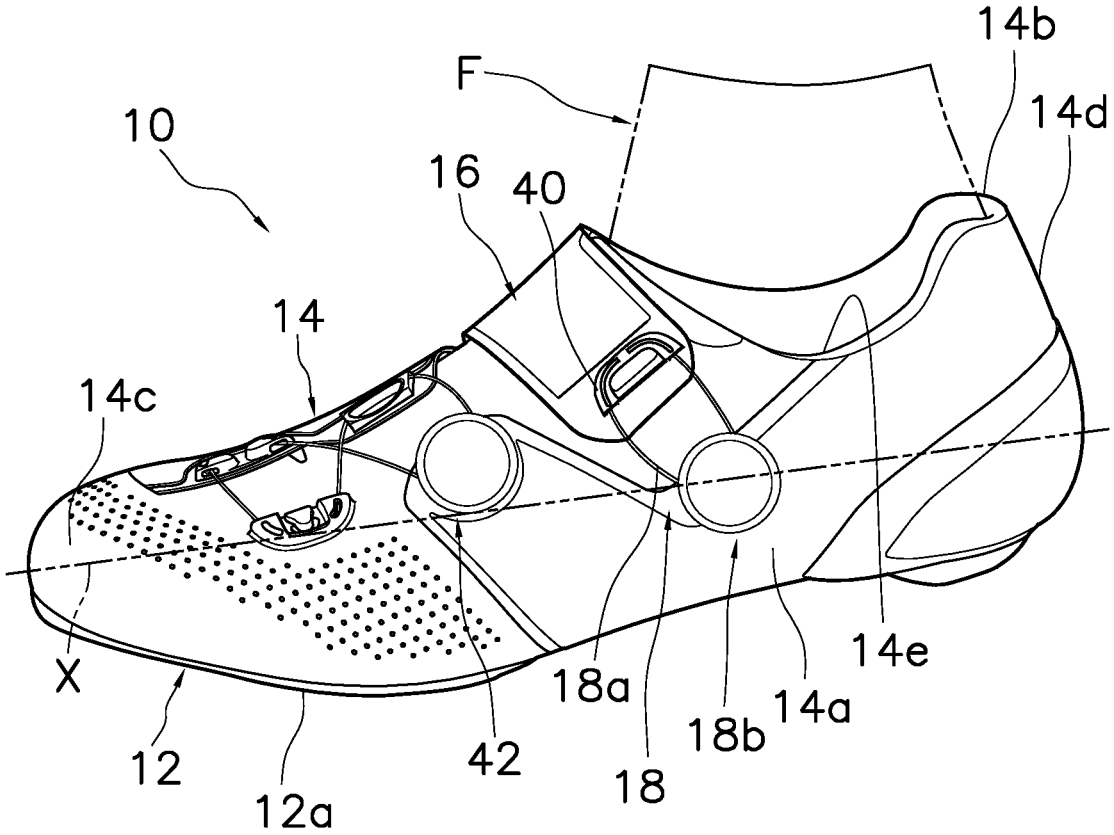
FIG. 8 is a side perspective view of a shoe according to another embodiment.

The embodiment described above has explained that the lace member 18*a* of the tightening structure 18 is attached to the upper 14, whereas the reel-up member 18*b* is attached to the strap 16. However, as shown in FIG. 8, the lace member 18*a* can be attached to the strap 16, whereas the reel-up member 18*b* can be attached to the upper 14.

Figure 9:
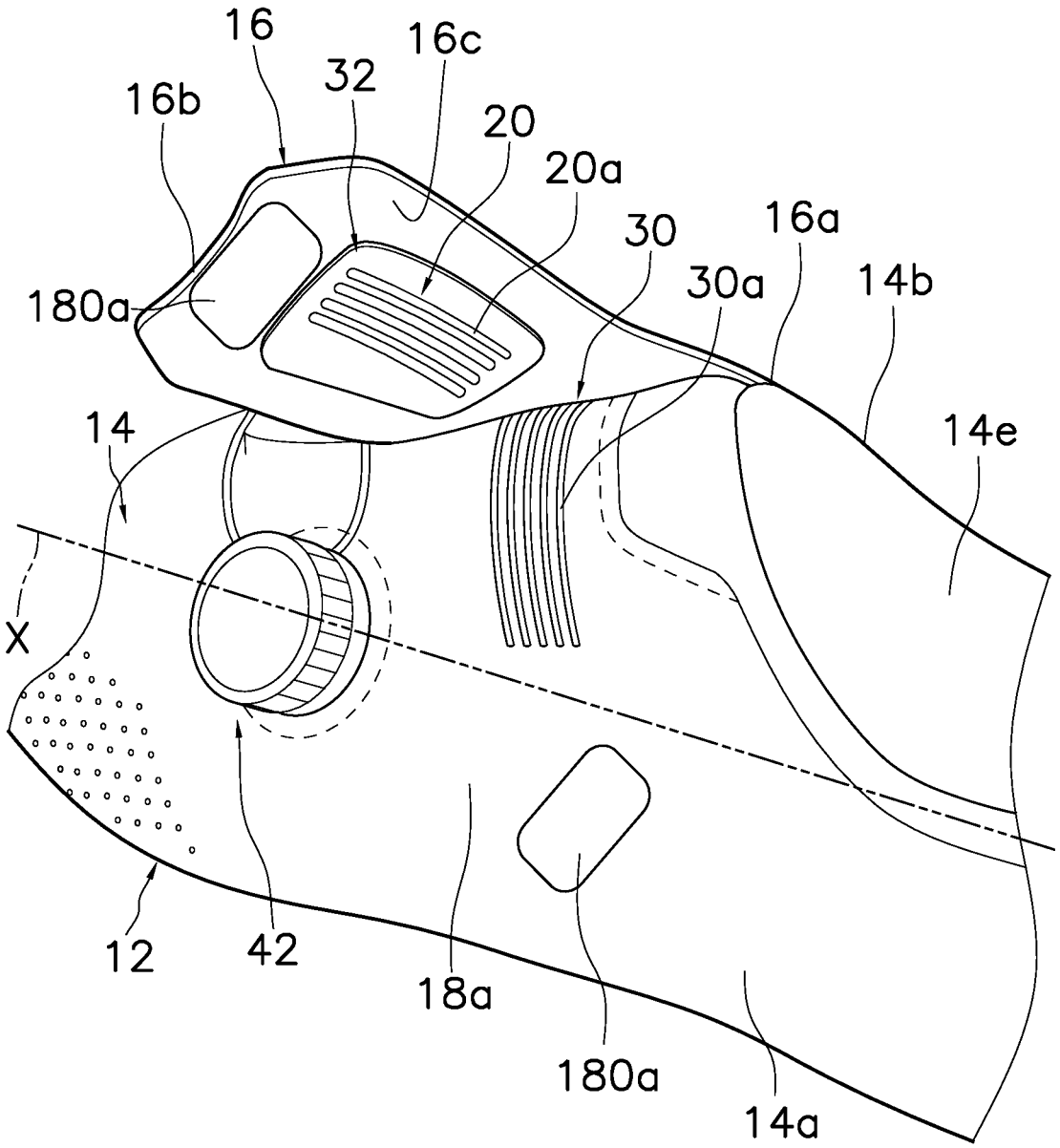
FIG. 9 is a perspective view of a portion of the shoe showing a condition that engagement between an upper and a strap of the shoe has been released according to another embodiment.

The embodiment described above has explained that the tightening structure 18 includes the lace member 18*a* and the reel-up member 18*b*. However, as shown in FIG. 9, the tightening structure 18 can be composed of touch fasteners 180*a* provided on the upper 14 and the strap 16, respectively. The touch fasteners 180*a*, each having a planer shape, are attachable to and detachable from each other. The touch fasteners 180*a* are, for example, made of specially treated cloths. The touch fasteners 180*a* are used for intention to bind fasteners in a repeatedly attachable and detachable manner. Touch fasteners are generally composed of a hook-raised fabric fastener and a loop-raised fabric fastener. When the both types of fasteners are pressed against each other, the hook-raised fabric and the loop-raised fabric are configured to attach to each other.

Figure 10:
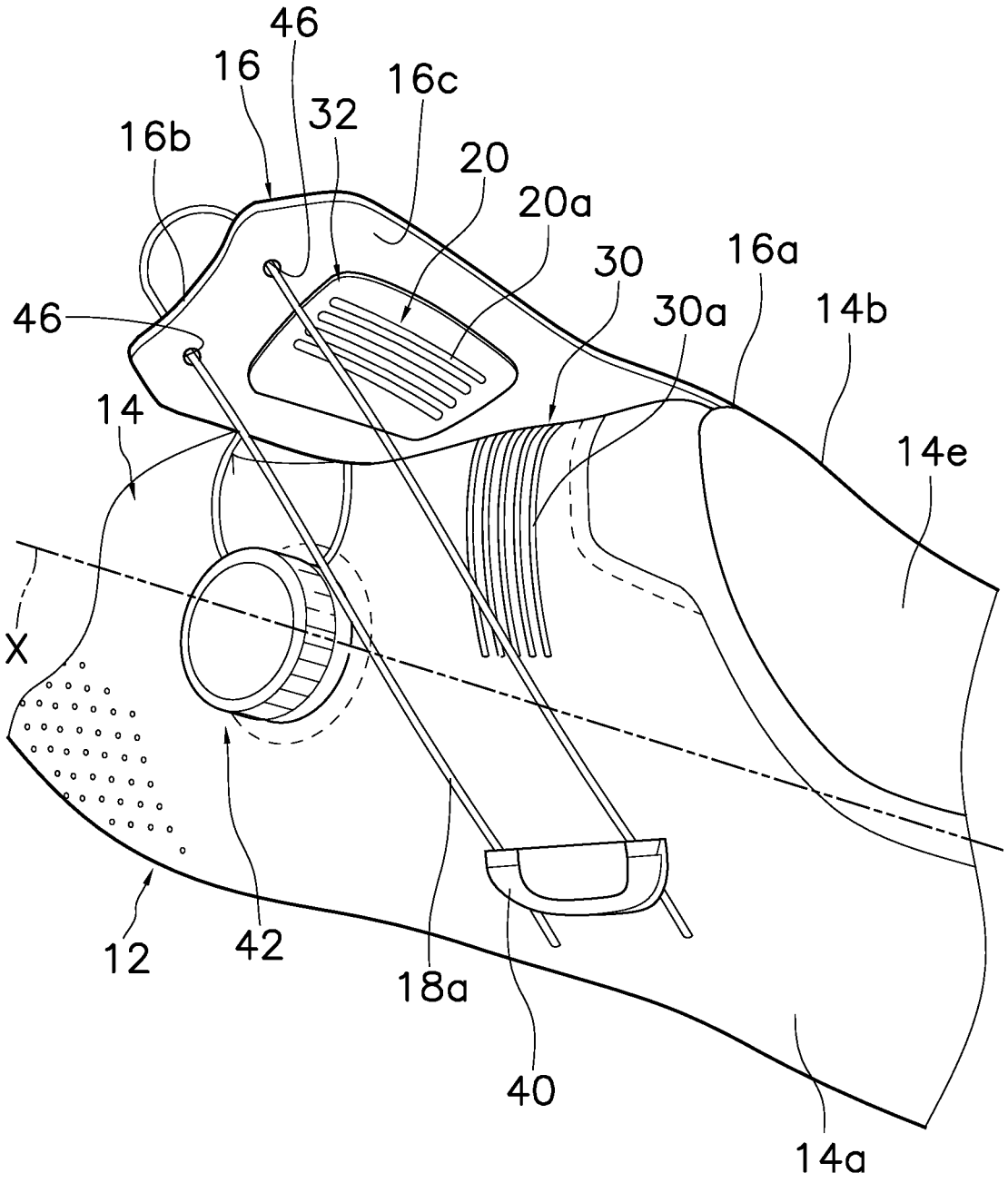
FIG. 10 is a perspective view of a portion of the shoe showing a condition that engagement between an upper and a strap of the shoe has been released according to another embodiment.
Figure 11:
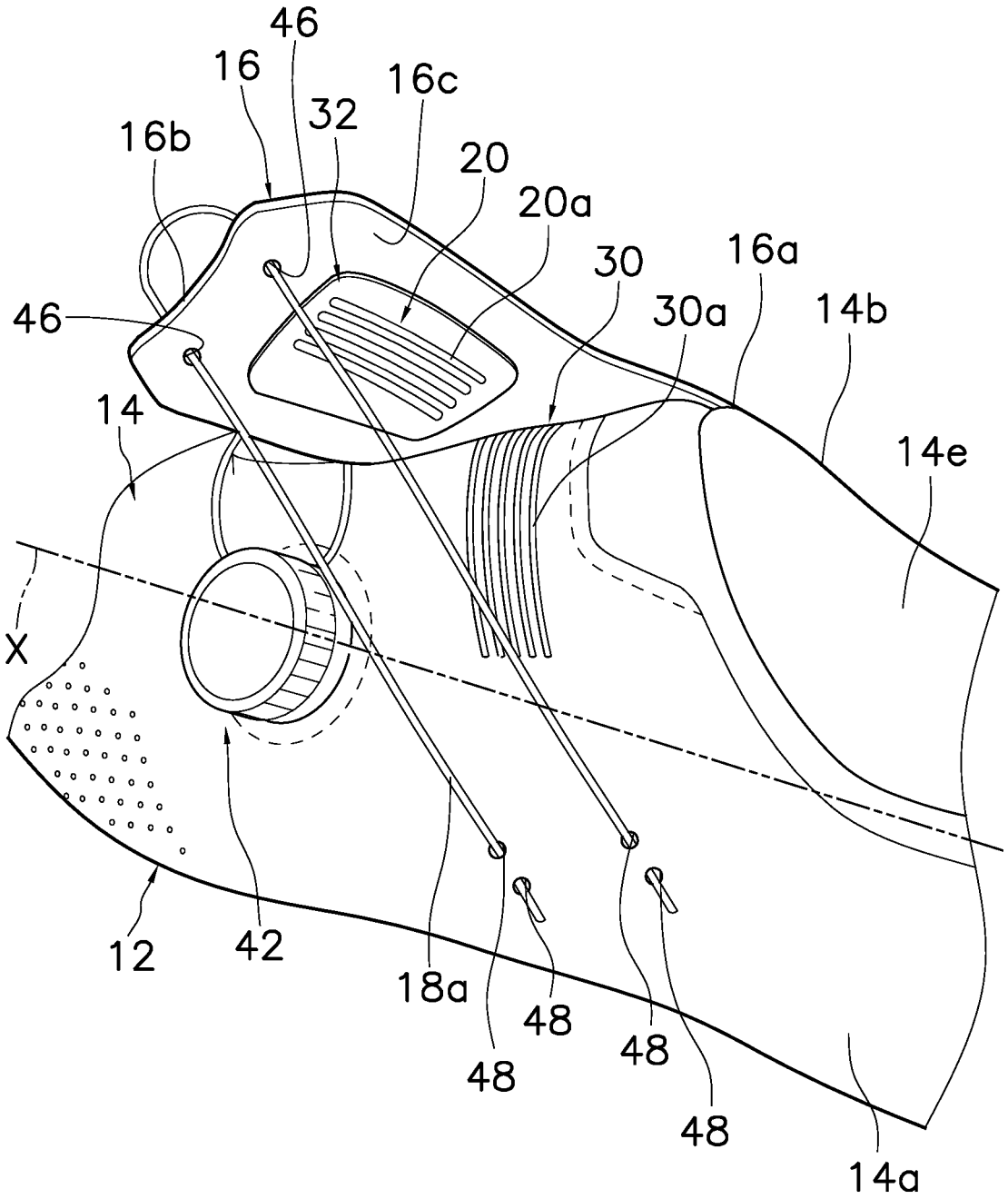
FIG. 11 is a perspective view of a portion of the shoe showing a condition that engagement between an upper and a strap of the shoe has been released according to another embodiment.

The embodiment described above has explained that the tightening structure 18 includes the reel-up member 18*b*. However, the reel-up member 18*b* can be omitted from the tightening structure 18. For example, as shown in FIG. 10, the lace member 18*a* is inserted through at least one hole 46 provided in the distal end 16*b* of the strap 16. Then, both ends of the lace member 18*a* are tied, while the lace member 18*a* is hooked on the hook portion 40 provided on the upper 14 side. Accordingly, the lace member 18*a* can be fastened. Moreover, the hook portion 40 can be omitted. In this case, for example, as shown in FIG. 11, the upper 14 can be provided with at least one hole 48 for inserting the lace member 18*a* therethrough. The lace member 18*a* is inserted through the at least one hole 46 provided in the distal end 16*b* of the strap 16 and the at least one hole 48 provided in the upper 14. Then, both ends of the lace member 18*a* are tied, whereby the lace member 18*a* can be fastened. It should be noted that in the present embodiment, the lace member 18*a* is tied on a side with the upper 14. However, the lace member 18*a* can be tied on a side with the strap 16.

Figure 12:
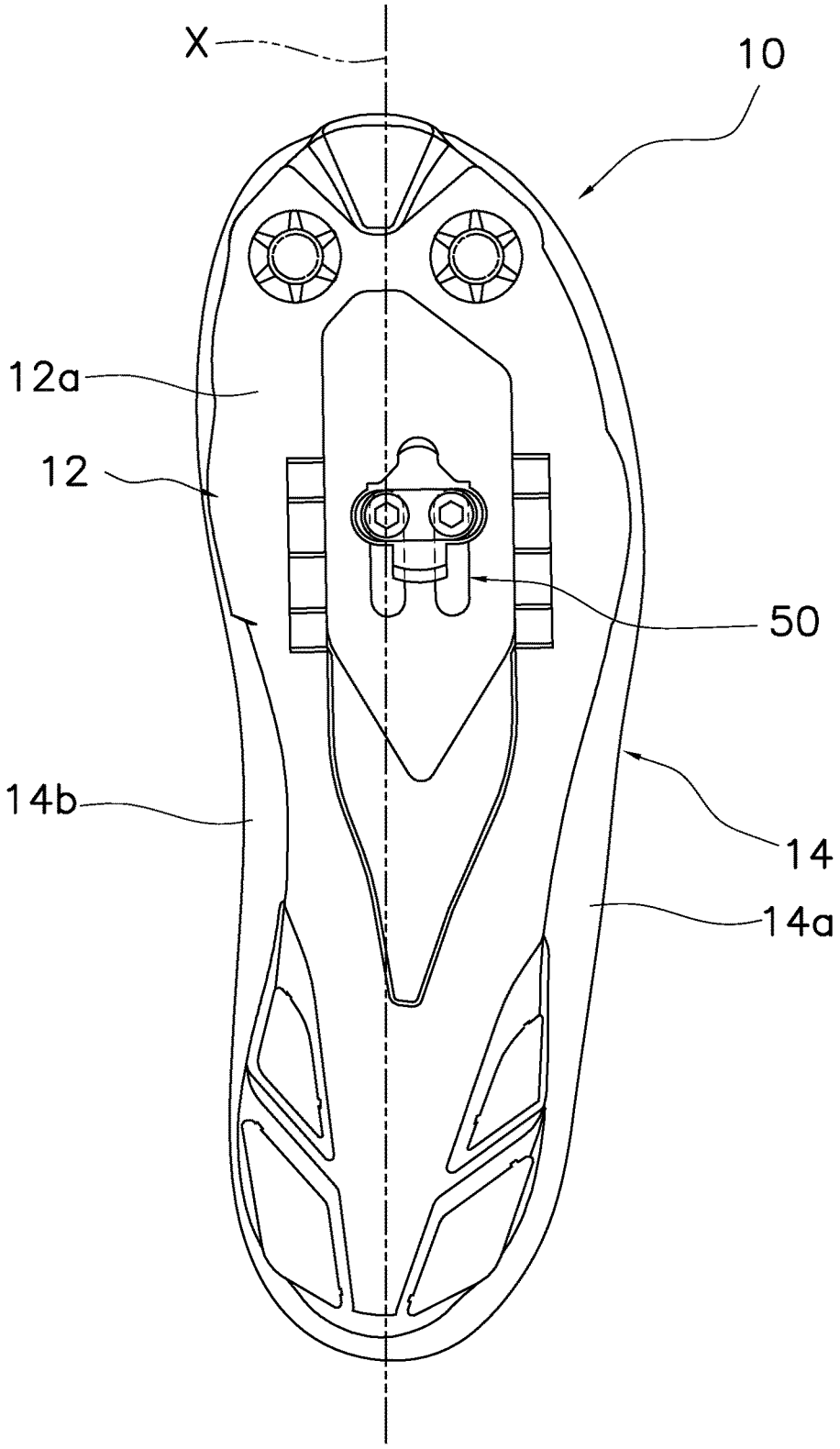
FIG. 12 is a bottom view of a shoe according to another embodiment.

The shoe 10 may be a cycling shoe. In this case, for example, as shown in FIG. 12, the shoe 10 can further include an attachment portion 50 that a cleat (not shown in the drawing) is attached. The cleat is a plate-shaped member attached to the sole of a cycling shoe. When the cleat is engaged with a bicycle pedal, the cycling shoe and the bicycle pedal are engaged.

What is claimed is:

1. A shoe comprising:

a sole;

an upper attached to the sole; and a strap extending in a width direction of the shoe, the strap including a proximal end and a distal end, the proximal end fixed to the upper, the distal end being located on an opposite side of the proximal end in the width direction of the shoe, one of the upper and the strap including at least one first engaging portion, the at least one first engaging portion includes at least one first protrusion, and the other of the upper and the strap including at least one second engaging portion, the at least one second engaging portion being engaged with the at least one first engaging portion while extending in a direction intersecting with a longitudinal direction of the shoe where the distal end is held against the upper, the at least one second engaging portion includes a plurality of second protrusions arranged in the longitudinal direction of the shoe, and the at least one first protrusion is configured to be engaged between adjacent two of the plurality of second protrusions where the distal end is held against the upper.

2. The shoe according to claim 1, wherein the at least one second engaging portion includes at least one groove, and the at least one first protrusion is configured to be engaged with the at least one groove where the distal end is held against the upper.

3. The shoe according to claim 1, wherein the at least one first engaging portion extends in the direction intersecting with the longitudinal direction of the shoe when the distal end is held against the upper.

4. The shoe according to claim 1, further comprising:

a tightening structure configured to apply a tension to the strap.

5. The shoe according to claim 4, wherein the at least one second engaging portion is provided on the upper, and the tightening structure applies the tension to the strap such that the tension is directed along the at least one second engaging portion.

6. The shoe according to claim 2, wherein the tightening structure includes a lace member attached to one of the upper and the strap, and a reel-up member attached to the other of the upper and the strap, the reel-up member is configured to reel up the lace member.

7. The shoe according to claim 1, wherein one of the at least one first engaging portion and the at least one second engaging portion is made of a mesh material.

8. The shoe according to claim 7, wherein the one of the at least one first engaging portion and the at least one second engaging portion is provided on the strap.

* * * * *